United States Patent [19]

Heel et al.

[11] Patent Number: 4,666,096

[45] Date of Patent: May 19, 1987

[54] THREAD SPOOLER

[75] Inventors: Helmut Heel, Lengenwang; Reimer Claussen, Altusried; Frank Schick, Heising, all of Fed. Rep. of Germany

[73] Assignee: A. Ott GmbH

[21] Appl. No.: 790,060

[22] Filed: Oct. 22, 1985

[30] Foreign Application Priority Data

Oct. 24, 1984 [DE] Fed. Rep. of Germany ..... 3438962

[51] Int. Cl.[4] ..... B65H 63/00

[52] U.S. Cl. ..... 242/36; 242/18 R; 242/45

[58] Field of Search ..... 242/36, 18 R, 18.1, 242/37 R, 45

[56] References Cited

U.S. PATENT DOCUMENTS

| | | | |
|---|---|---|---|
| 3,536,272 | 10/1970 | Ueyama | 242/45 |
| 3,774,860 | 11/1973 | Loepfe | 242/36 |
| 3,844,498 | 10/1974 | Loepfe | 242/36 |
| 3,860,187 | 1/1975 | Liska | 242/45 |
| 4,007,457 | 2/1977 | Aeppli | 242/36 X |
| 4,059,239 | 11/1977 | Hori et al. | 242/18 R X |
| 4,458,849 | 7/1984 | Miyake et al. | 242/36 |
| 4,494,702 | 1/1985 | Miyake et al. | 242/18 R |

FOREIGN PATENT DOCUMENTS

| | | | |
|---|---|---|---|
| 2720281 | 5/1978 | Fed. Rep. of Germany | 242/36 |
| 619424 | 9/1980 | Fed. Rep. of Germany . | |
| 3005746 | 8/1981 | Fed. Rep. of Germany . | |
| 3240486 | 6/1983 | Fed. Rep. of Germany . | |

*Primary Examiner*—Stanley N. Gilreath
*Attorney, Agent, or Firm*—Toren, McGeady and Goldberg

[57] ABSTRACT

A thread spooler includes a plurality of spool units, each of which includes a thread defect sensor of a defect classification device which reacts to defects of the thread to be wound up. A large number of sets of predetermined operational parameters of the spool units and/or the defect classification devices can be recorded by a central input device into a central memory which stores all these data simultaneously. Each of the spool units includes a decentralized memory, into which one of the centrally stored operational parameter sets can be loaded individually for each spool unit by a call-up switch. A central control determines for respective groups of spool units a predetermined sequence, in which the operational parameter sets can be called up by the spool units. The classification device determines the thread defect, preferably individually for each spool unit, and indeed respectively referred onto the last wound gauged length of the thread. The winding device of the spool unit is operated with the maximum possible rpm. The rpm is reduced if a predetermined maximum thread speed is reached.

13 Claims, 2 Drawing Figures

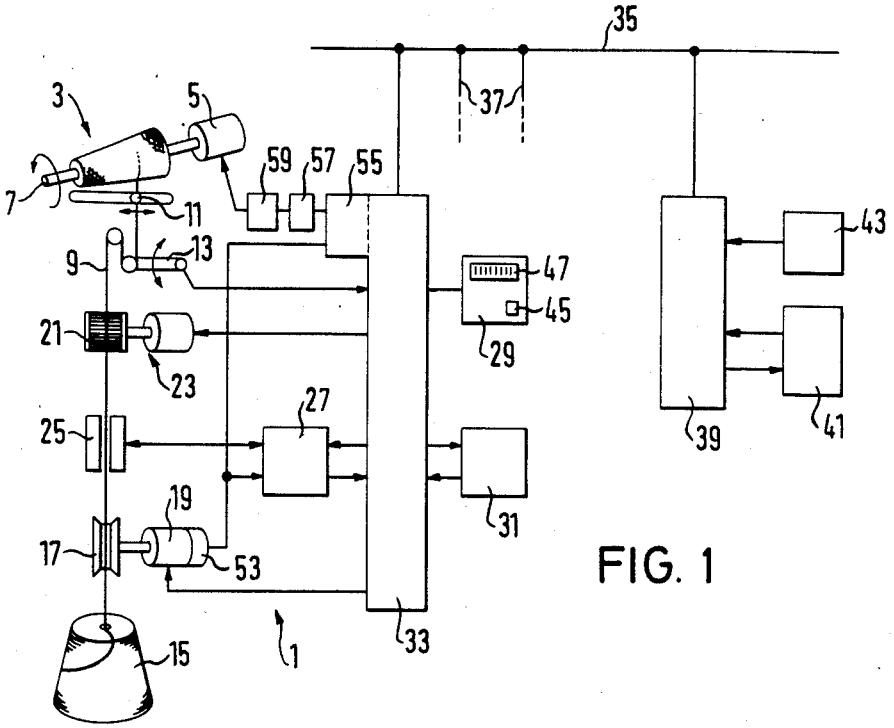
FIG. 1
FIG. 2
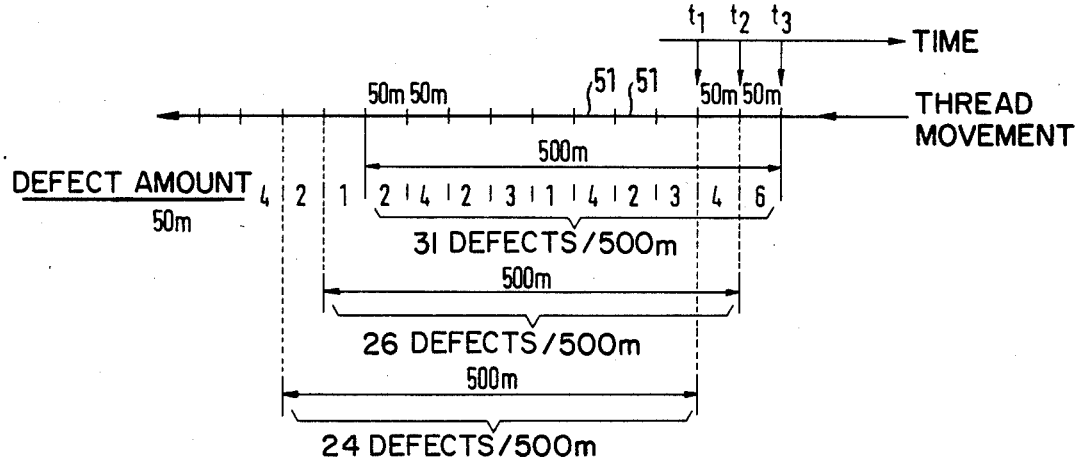

THREAD SPOOLER

FIELD OF THE INVENTION

The invention is directed to a thread spooler and, in particular, a thread spooler of the type having a plurality of spool units, a defect classification device, an input device, a memory device and a control device.

BACKGROUND OF THE PRESENT INVENTION

Spoolers for sewing threads and the like must, if they are to operate economically, be operated with downtimes which are as short as possible. This applies not only to replacement of already finish wound spools or bobbins during winding of a load, but also for the changing of the load because here, as a rule, the operating parameters of the spoolers have to be newly adjusted.

In the fabrication of high quality threads or yarns, yarn defect sensors are provided at the spool units of spoolers, which react to defects of the thread to be wound by the spool unit. A defect classification device classifies the registered thread defects and subdivides the thread production into several quality classes. Apart from the quality class "defect-free thread", one can classify quality classes, in which the thread has defects, which, to be sure, permit further processing, however, if they occur too often, lead to problems, such as with respect to sewability or to optical discrepancies. As the lowest quality class, it is possible to register defects in which the thread cannot be processed further, for instance, since it contains thickened spots which can lead to needle fractures. In particular, in case of defects of the last mentioned type, the classification device stops the spool unit, so that the thread can be cleaned up, for instance, by cutting out and reknotting or splicing of the cutout spot.

In spoolers comprising such classification devices, a very high quantity of operational parameters must be preset, so that the setup of the spooler is relatively time consuming. Conventional spoolers do not operate during the setup operation. Further, essential downtime results at the termination of the load since the operational parameter set is associated with a large number of spool units, if not the entirety of the spool units, and with conventional spoolers, one has to wait until the last spool of the load is wound up before the new operational parameter sets can be set up. In the most unfavorable cases, this can lead to a predominant number of the spool units of the machine being idle for periods exceeding an hour, while merely several spool units are finish winding the load.

It is an object of the present invention to show, by way of a simple design, how downtimes of a thread spooler can be reduced during change of the loads to be wound or rolled up and, at the same time, to increase the operational dependability of the machine.

SUMMARY OF THE INVENTION

In the spooler according to the invention, the operational parameter sets which control the operation of the spool units and the classification device are stored in a central memory of the spooler. The central memory is capable of storing a large quantity of operational parameter sets and, at the least, stores the operational parameter sets of the loads to be wound or rolled up successively on the spooler. Each spool unit comprises a decentralized memory, in which the operational parameter sets of the load to be actually rolled up is stored. At each spool unit, there is provided a manually operable call-up switch, by means of which the decentralized memory of the spool unit can be loaded with the operational parameter set of the next load, if the operating personnel of the spooler determines that the thread or yarn supply to be processed into a load is exhausted. The operational parameter set of each of the spool units can therefore be individually determined, and to be sure without it being necessary to adjust a multitude of operational parameters at each spool unit. In order to change the parameter, merely one single switch has to be operated, whereby setup errors are largely avoided. A change in parameters can therefore also be accomplished by less qualified operating personnel.

The call-up switch provided at each spool unit can be designed as a selection switch, by means of which a predetermined quantity of operational parameter sets can be selectively chosen. Since, however, the danger of operator's errors increases with an increasing quantity of operational parameter sets selectable by the call-switch, the quantity of operational parameter sets is suitably limited, even when the central memory can store a considerably larger quantity of operational parameter sets.

In a preferred embodiment form, a central control determines a predetermined sequence, in which the operational parameter sets can be called up from the central memory. By means of the call-up switch of each of the spool units, the next following operational parameter set can then be merely called up in predetermined call-up sequence by the central control for the spool unit concerned. The call-switch can therefore be designed as a push-button switch, whereby the operational parameter set of the next following load can be loaded by depressing the push-button.

In order to be able to monitor which of the spool units participating in the fabrication of a load have already been switched over onto the operational parameters of the next following load, a display device is suitably provided at each spool unit, which indicates the operation of the call-up switch for this spool unit. It has been shown to be favorable, if the display device is designed as a flasher or blinker control of a digital display apparatus showing the length of thread required to be rolled up.

In a preferred embodiment form, the central control determines the preset call-up sequence, respectively, for a selectable group of spool units. In this way, several loads simultaneously can be rolled up on one spooler in spite of a most simple operation, and the transition of one load to the next one can also be preprogrammed, even if hereby the quantity of the spool units participating in the rolling up of a load varies. In the previously explained spooler, the operational parameters are all available in the decentralized memory of the spool unit. This has the advantage that individual classification criteria can be established at each spool unit and each spool station can be individually controlled. In particular, it can be individually switched off if an intolerable discrepancy is registered. In conventional classification devices, the thread deficiencies are determined overall, for instance, over the entire load, and an average value referred to a predetermined standard length is computed from the total number of discrepancies. If a decentralized memory of the previously explained type is used, operational parameters of the classification device, meaning also discrepancy or defect criteria, are available at the spool unit. Thus, it is possible to determine the defect quantity individually "in a sliding manner", respectively, on a just finished rolled thread section of predetermined length for the individual spool unit. It is not only possible to achieve a considerably more accurate classification of the load, but it is also possible to have a defined classification of the individual spool. The improved classification is achieved in that each spool unit comprises a computer circuit which counts the quantity of the thread discrepancies registered and classified by the thread discrepancy sensor of the spool unit, which discrepancies occur in thread length increments. Thread defect numbers of the same class of thread length increments directly succeeding each other are added up to give a total defect number and the operation of the spool unit is controlled depending upon this total defect number. In order to achieve a topical indication of this overall defect number, the total defect number for each added thread length increment is reduced by the defect number of the increment preceding it by the predetermined number of increments.

In spoolers which work with a constant thread speed, the length of the increments can be fixed by means of constant time intervals. If the spooler works with constant wind-on rpm, then a constant length of the increments can be determined through integration of tachometer signals over time, which represent the thread speed. Signals which represent the operating sequence of the increments are hereby preferably produced as a function of the value of the integral.

An error classification device of the previously described type can also be utilized in spoolers other than those described above, if the spoolers have a call-up device for operating parameter sets, provided that memories for the operating parameters for the defect classification device have been provided at the spool units.

A further feature of the invention, which can also be used in other spoolers, concerns the spool winding device. This comprises a thread guide which determines the winding pattern of the spool or bobbin. The inertia of the spool guide very often limits the rpm with which the spool to be wound up is driven. A further factor limiting the operational speed of the spool unit results from the additional devices usually provided at spoolers, in particular, the waxing device which only functions satisfactorily below preset speed limits. In order to be able to work with as high a winding spindle rpm as possible and to hereby increase the effectiveness of the spool or bobbin unit, a preferred embodiment provides that the rpm of the motor driving the spindle of the spool winding device is controlled by an rpm control depending on a signal representing the thread speed. The rpm control drives the motor with a predetermined rpm if the thread speed is lower than a predetermined speed value. For the rest of it, the rpm of the motor is reduced to such an extent that the thread speed remains essentially equal to this predetermined speed value. For optimum effectiveness of the machine, the predetermined motor rpm has been chosen so that the thread guide can function satisfactorily. The predetermined thread speed is chosen to be so high that the satisfactory operation of the additional devices of the spool unit and particularly of the waxing device is still assured.

The rpm control is preferably a component of the previously mentioned decentralized control, in particular, designed as a microprocessor. In order to avoid malfunction of the decentralized control caused by the motor operation, the motor is suitably connected to the rpm control by means of an optical coupling device. The rpm control generates sequential pulse signals and controls the rpm by means of the pulse frequency and/or the pulse duty factor of the pulse signal. Control depending on pulse duty factor at constant pulse repetition frequency is favored since here, by means of a simple low pass filter, a d.c. voltage signal suitable for the control of the motor can be generated.

For a better understanding of the present invention, reference is made to the following description and accompanying drawings, while the scope of the present invention will be pointed out in the appended claims.

BRIEF DESCRIPTION OF THE DRAWINGS

In the drawings:

FIG. 1 depicts a block diagram of a spooler control; and

FIG. 2 is a graphical diagram for explaining the operation classification device of the spooler.

DESCRIPTION OF THE PREFERRED EMBODIMENTS

The three spooler comprises a plurality of identically constructed spooler or bobbin units 1, of which FIG. 1 shows only one single spool unit. Each spool unit 1 comprises a winding device 3 with a spindle 7 driven by an electromotor 5, to which winding device the thread 9 to be wound up is directed through a thread guide 11, which determines the winding pattern of the spool being wound up. The thread 9, in connection with which we are dealing in particular with sewing yarn, is supplied to the thread guide 11 over a thread tension gauge 13, for instance, a compensating lever, from a supply bobbin 15. Between the thread tension gauge 13 and the supply bobbin 15, the thread 9 runs over a measuring wheel 17, which is coupled with an electrical braking device, in particular a hysteresis brake 19. The hysteresis brake 19 is controlled in such a way depending on the thread tension gauge 13, that the thread tension is constant at the thread guide 11. Circuits suitable for this are known and will now be described in detail here.

Between the measuring wheel 17 and the thread tension gauge 13, the thread 9 runs over a waxing roller 21 of a waxing device 23. The waxing device 23 can also be designed in a conventional manner.

The thread 9 to be wound up runs appropriately between the waxing roller 21 and the measuring wheel 17 through a measuring head 25 of a classification device 27, which reacts to configuration defects of the thread 9 registered by the measuring head 25, which classifies the defects and counts them, as well as controls the operation of the spool unit 1 depending upon the number of defects. The measuring head 25 can be equipped with conventional sensors which react, for instance, to the thickness of the thread 9, its color, its reflectivity, roughness and other similar properties. The classification device 27 allows classification into several classes of quality, depending on the nature of the registered defects and their frequency in the lastly wound thread section of predetermined length. In case of thread defects which cannot be tolerated, the spool unit 1 is stopped. The measuring head 25 may include a cutting device which cuts the thread 9 in order to remove the defective portion. A recording device can be connected to the classification device 27, which permits recording of all defects occurring in the associated spool unit 1.

A large number of operational parameter data are required for the control of the spool unit 1 and particularly of the classification device 27, which can be entered at an input device 29 of the spool unit 1 and are stored in a memory 31 of the spool unit 1. A control 33, which is preferably a microprocessor, controls the operation of the spool unit 1 depending upon the operational parameter data set presently stored in the memory 31. The control 33 is connected by a data bus 35 with a central control 39, the controls of the remaining spool units being also connected to the same data bus as indicated at 37. A central memory 41 is assigned to the central control 39 in which a plurality of operational parameter data sets can be stored. The operational parameter data sets can be recorded in the central memory 41 by means of an input device 43. The central control 39 determines the association of the data sets with predetermined groups of spool units. Over and above that, it determines the sequence in which these data sets can be supplied to the associated spool units. The input device 29 of each spool unit 1 comprises a call-up switch 45, for instance, in the shape of a push-button, at the actuation of which the operational parameter data set hitherto stored in the memory 31 is erased and the next following data set determined by the preset sequence of the central control 39 is loaded into the memory 31. The change of the data set is indicated at the input device 29, for instance, through blinking of a digital display 47, at which the required thread length can be read. Since the operational parameter data sets can be individually loaded into the memory 31 in the spool unit in spite of the assignment to groups of spool units, one does not have to wait, after having used up the supply bobbins provided for a load, until all the spool units participating in the winding of a load have finished their wind-up operation. The downtimes of the machine caused by the parameter change can thus be considerably shortened.

The classification device 27 monitors a predetermined length of the lastly wound thread. For this purpose, as is shown in FIG. 2, respective thread increments 51 with predetermined equal length of, for example, 50 m are monitored as to defects of a certain type predetermined by the operational parameter data. The quantity of the defects per increment is counted and stored in the form associated with the increment. Over and above that, the classification device adds up the quantity of the defects of a predetermined number of increments and thus determines the total defect number for the standard section of the thread, to which the total defect quantity has to be referred. In FIG. 2, the defect quantities of 10 increments are added up corresponding to a total sector of 500 m by way of an example. This overall defect number is continuously maintained to be optical in that, at the determination of the defect in the momentary increment and its addition to the total defect quantity, this total defect quantity is diminished by the number of defects of the previous increment corresponding to the predetermined increment quantity. If, for instance, the total defect quantity at the point in time $t_1$ is 24 defects per 500 m, for determination of the total defect quantity after a further increment of 50 m, meaning at the point in time $t_2$, the total defect quantity referred to 500 m is increased by the quantity of defects in the new interval, meaning by 4, and, at the same time, reduced by the number of defects at the interval lying back by 500 m, meaning by 2. At the point in time of $t_2$, there result 26 defects per 500 m. At the point in time of $t_3$, there result in analogous fashion 31 defects per 500 m.

If the spool unit 1 were to be adjusted in such a way so that the thread 9 runs with constant thread speed, then the thread length increments 51 can be measured by time links, meaning by constant time intervals.

In the embodiment example described, the winding device 3 works with a constant rpm of the spindle 7. Thus, the thread speed is dependent upon the spindle diameter. In order to be able to measure the increments 51, a tachometer 53 is coupled with a measuring wheel 17, which generates a speed signal proportional to the thread speed, for instance, a pulse signal with pulse frequency proportional to the thread speed, and passes this on to the classification device 27. The classification device 27 integrates the speed signal and determines the length of the increments, in particular, by consecutively counting a predetermined quantity of pulses of the pulse signals.

The rpm of the motor 5 of the winding device 3 is controlled by an rpm control 55 depending upon the speed signal of the tachometer 53. As long as the thread speed is lower than a predetermined speed value, the motor 5 operates with maximum velocity essentially limited only by the inertia or the maximum operational speed of the thread guide 11. When the thread speed reaches this predetermined speed value, then the rpm circuit 55 regulates the rpm of the motor 5 in such a way that the thread speed remains constant at the predetermined speed value. The predetermined speed value is essentially determined by the maximum operating speed of the waxing device 23. A speed control of this type optimizes in a simple design fashion the efficiency of the spool unit.

The rpm control circuit 55 is preferably part of the decentralized control 33, in particular, formed by a microprocessor. In order to avoid interfering feedback actions of the motor 5 onto the microprocessor, an optical coupler 57 is switched between the motor 5 and the rpm control circuit 55. In order to make do with as small a number of optical couplers as possible, the rpm control circuit sends, via the optical coupler 57, a serial pulse signal of constant frequency to a drive circuit 59 of the motor 5 and controls the rpm of the motor 5 by varying the pulse duty factor of said pulse signal. The drive circuit 59 includes a low pass filter which converts the pulse signal into a d.c. voltage corresponding to the pulse duty factor. The rpm of the motor 5 is controlled as a function of this d.c. voltage.

While the foregoing description and drawings represent the preferred embodiments of the present invention, it will be obvious to those skilled in the art that various changes and modifications may be made therein without departing from the true spirit and scope of the present invention.

What is claimed is:

1. a thread spooler comprising:

(a) a plurality of spool units, each having a spool winding device driven by a motor and a thread defect sensor reacting to defects of the thread which is supplied to the spool winding device for the purpose of being wound;

(b) at least one defect classification device responsive to the thread defect sensors of the spool units;

(c) an input device for inputting sets of predetermined operational parameters of the spool units or of the defect classification device or both;
(d) a memory device for the predetermined operational parameters;
(e) a control device for controlling the spool winding device depending upon the predetermined operational parameters and depending on the defect classification device;
(f) said memory device including a central memory for simultaneously storing a plurality of said predetermined operational parameters sets inputted by the input device, and a respective decentralized memory at each of the spool units, each for storing one of the operational parameter sets;
(g) said control device including a respective decentralized control at each spool unit, which controls the operation of the spool unit as a function of the operational parameter set stored in the respective decentralized memory; and
(h) each respective decentralized control at the spool unit including a manually operable call-up switch, with which a selectable operational parameter set of the central memory can be called up and recorded in the respective decentralized memory of the spool unit.

2. A thread spooler according to claim 1, wherein the control device further comprises a central control, which selectively determines a predetermined call-up sequence of the operational parameter sets from the central memory and wherein, at operation of the call-up switch, the operational parameter set of the central memory which is next in the predetermined call-up sequence, is recorded into the decentralized memory of the spool unit associated with said call-up switch.

3. A thread spooler according to claim 2, wherein the call-up switch is a push-button type switch.

4. A thread spooler according to claim 2, wherein a display device is provided at the spool unit, which displays the operation of the call-up switch for the call-up of the next following operational parameter set.

5. A thread spooler according to claim 4, wherein the display device is designed as a blinker control of a digital display unit displaying the thread length required to be wound up.

6. A thread spooler according to claim 2, wherein the central control determines the preset call-up sequence respectively for a selectable group of spool units.

7. A thread spooler according to claim 1, wherein the defect classification device comprises a computer circuit at each spool unit, which counts the number of thread defects in directly consecutive thread length increments which have been registered and classified by the thread defect sensor of the spool unit, and also adds the defect quantities of a predetermined number of consecutive thread length increments resulting in a total defect quantity and which controls the operation of the spool unit depending upon the total defect quantity and that the computer circuit reduces the total defect quantity for each accruing thread length increment by the defect number of the thread length increment preceding the predetermined number of thread length increments.

8. A thread spooler according to claim 7, wherein each spool unit comprises a tachometer which supplies a signal proportional to the thread speed and wherein the computer circuit calculates the thread length increments depending upon the time integral of the tachometer signal and generates a signal representing the run sequence of the thread increment, as soon as the integral reaches a predetermined value.

9. A thread spooler according to claim 1, wherein the spool unit comprises a tachometer which supplies a speed signal proportional to the thread speed and wherein the motor of the spool winding device is connected to an rpm control controlling the rpm of the motor as a function of the speed signal, said rpm control driving the motor at a preset rpm if the thread speed is lower than the preset speed value and for the rest it reduces the rpm of the motor to such an extent that the thread speed essentially equals the preset speed value.

10. A thread spooler according to claim 9, wherein the rpm control supplies a serial pulse signal through an optical coupler for driving the motor and varies the pulse frequency and/or the pulse duty factor of the pulse signal for the purpose of controlling the rpm of the motor.

11. A thread spooler according to claim 10, wherein the rpm control varies the pulse duty factor of the pulse signal for controlling the rpm of the motor and wherein the motor is connected to the optical coupling device through a low pass filter.

12. A thread spooler comprising:
(a) a plurality of spool units, each having a spool winding device driven by a motor and a thread defect sensor reacting to defects of the thread which is supplied to the spool winding device for the purpose of being wound;
(b) at least one defect classification device responsive to the thread defect sensors of the spool units;
(c) an input device for recording sets of predetermined operational parameters of the spool units or of the defect classification device or both;
(d) a memory device for the recorded sets of operational parameters;
(e) a control device for controlling the spool winding device depending upon the stored operational parameters and depending on the defect classification device;
(f) said defect classification device including a computing circuit at each spool unit which counts the number of thread defects in directly consecutive thread length increments registered by the thread defect sensor of the spool unit and also adds the defect numbers of a predetermined quantity of consecutive thread length increments to an overall defect number and controls the operation of the spool unit depending on the overall defect quantity and wherein the computing circuit reaches the overall defect quantity for each accruing thread length increment by the defect number of the thread length increment preceding the predetermined number of thread length increments.

13. A thread spooler according to claim 12, wherein each spool unit comprises a tachometer which supplies a signal proportional to the thread speed and that the computing circuit determines the thread length increments depending upon the time integral of the tachometer signal and generates a signal representing the run sequence of the thread increment, if the increment reaches a predetermind value.

* * * * *